US005590509A

United States Patent [19]

Esteves et al.

[11] Patent Number: 5,590,509

[45] Date of Patent: Jan. 7, 1997

[54] PROCESS AND MACHINE FOR CONDITIONING ANY PRODUCTS IN CONTAINERS SUCH AS BARQUETTES

[75] Inventors: Robert Esteves, Champhol; Michel Fruchard, Leves, both of France

[73] Assignee: W. R. Grace & Co-Conn., Duncan, S.C.

[21] Appl. No.: 216,394

[22] Filed: Mar. 23, 1994

[51] Int. Cl.[6] ..... B65B 31/02

[52] U.S. Cl. ..... 53/432; 53/510; 53/557; 53/433; 53/442

[58] Field of Search ..... 53/432, 433, 442, 53/557, 510, 511

[56] References Cited

U.S. PATENT DOCUMENTS

| | | | |
|---|---|---|---|
| 4,034,536 | 7/1977 | Mahaffy et al. | 53/433 |
| 4,747,253 | 5/1988 | Schulte | 53/433 |
| 4,831,811 | 5/1989 | Nixon, Jr. et al. | 53/433 |
| 4,964,259 | 10/1990 | Yluisaker et al. | 53/433 |
| 5,179,819 | 1/1993 | Sukeyasu et al. | 53/557 |
| 5,237,800 | 8/1993 | Omori | 53/433 |

*Primary Examiner*—John Sipos
*Assistant Examiner*—Gene L. Kim
*Attorney, Agent, or Firm*—Rupert B. Hurley, Jr.; John J. Wasatonic

[57] ABSTRACT

A process for packaging a product on a receptacle includes advancing a film tubing on a conveyor, the tubing having therein a product on a receptacle, the film having a forward end which is sealed; sending a gaseous mixture into the tubing; blowing heated air onto an outer surface of the forward sealed end region of the tubing to pre-shrink this end of the tubing and to expel gas rearwardly from the forward region; applying a vacuum inside the tubing from a rearward portion of the tubing of film, to facilitate the welding of the tubing of film at the rear portion of the container; heat sealing the tubing in an area rearward of the receptacle, so that the receptacle having the product thereon is surrounded by the film; separating the sealed tubing film portion from a remainder of the tubing film; and heat-shrinking the sealed portion of the film. The process of the invention solves a problem in the packaging of products of the "bloody offals type," i.e., in preventing the smearing of stains over the packaging film during the shrinking of the film against the product.

10 Claims, 1 Drawing Sheet

Figure 1:
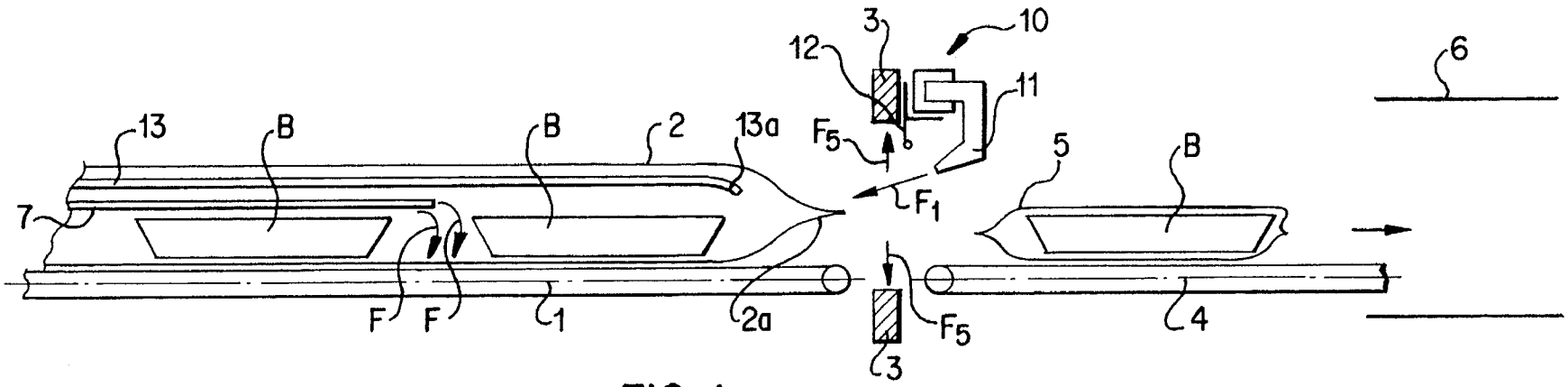

PROCESS AND MACHINE FOR CONDITIONING ANY PRODUCTS IN CONTAINERS SUCH AS BARQUETTES

Method of conditioning any products in containers such for example as boat-shaped receptacles and machine for applying this method.

The subject of the present invention essentially is a method of conditioning any products whatsoever in containers such in particular as boat-shaped receptacles.

It is directed to an improve machine for carrying out this method.

For sometime is already known a method of conditioning foodstuffs, wherein:

tubular film closed at its forward end and in which is accommodated at least one boat-shaped receptacle filled with a product is carried along on a conveyor, the tubular film undergoing inside a gas scavenging allowing the preservation of the products and keeping a tubular film in the inflated state, then the tubular film containing the boat-shaped receptacle is sealed by welding at the rear portion of the container, that tubular film portion in which the container is enclosed is then severed from the remaining portion of the tubular film, and this tubular film portion is at last subjected to a heat-shrinking within a furnace, thereby pressing the tubular film onto the periphery of the boat-shaped receptacle and of the product it contains.

When however the tubular film which appears in the form of a thin foil is closed by welding at the rear of the boat-shaped receptacle, gas of course remains entrapped within the pocket thus formed so that the film forms a bib blister above the boat-shaped receptacle.

To remedy this inconvenience there has already been proposed to use a foam pad exerting a pressure upon the film above the boat-shaped receptacle prior to the welding of the tubular film to the rest portion of the container. Such a pad however exhibits the inconvenience of putting the wrapping film in contact with the product contained in the boat-shaped receptacle, so that at the end of the conditioning process, i.e. after having been passed into the shrinkage-generating oven, the film comprises dirt and the product is not of a good quality to be put up for sale.

In the case of relatively dry products the residual dirt remaining on the film after shrinkage thereof is relatively not very substantial and does not penalize too much the visual appearance of the product.

But in the case of very moist products of the bloody offals type, the staining of the film is very substantial and strongly penalizes the visual aspect of the product hence its exhibition for a sale.

Therefore the object of the present invention is to remedy this inconvenience, i.e. to keep under control the lowering of the film onto the product contained within the boat-shaped receptacle to avoid the contact of this film with the product before the packed boat-shaped receptacle is passed into the heat-shrinking furnace or tunnel.

For that purpose the subject of the invention is a method of conditioning any products whatsoever such for instance as foodstuffs in containers having the shape of boat-shaped receptacles for example and of the type consisting in advancing on a conveyor or the like a tubular film closed at its forward end and into which is sent a gaseous mixture and is housed at least one container filled with products, obturating the tubular film by welding in the area of the rear end of the container, separating the tubular film portion into which the container is enclosed from the remaining portion of the tubular film and subjecting this tubular film portion to a heat-shrinking, characterized in that before obturating through welding the tubular film in the area of the rear portion of the container, one makes an injection of hot air onto the external wall of the tubular film from its closed front end down to at least its portion corresponding substantially to the middle of the container to thereby carry out a preshrinking of the tubular film and an expelling of the gaseous mixture rearwards; then one possibly provides a vacuum inside of the tubular film and from the rear thereof to complete the said expelling and to facilitate the step of welding the tubular film to the rear of the container.

According to another characterizing feature of this method, before applying vacuum into the tubular film, an injection of cold air is made upon the external wall of the said tubular film at its portion covering the rear of the container.

This invention is further directed to an improve conditioning machine for carrying out the method referred to hereinabove and of the type comprising at least one conveyor for transporting containers enclosed in a flexible tubular film, and, upstream of this conveyor, a system for obturating by welding the tubular film followed by a furnace for heat-shrinking said tubular film, characterized by an apparatus with a hot air injection nozzle interposed between the conveyor and the aforesaid furnace and preferably associated with the obturating system.

This machine is further characterized in that above the aforesaid conveyor is provided at least one duct received into the tubular film and communicating with a vacuum source.

According to still another characterizing feature of this machine, a cold air injection means is associated with the hot air injection apparatus.

Figure 2:
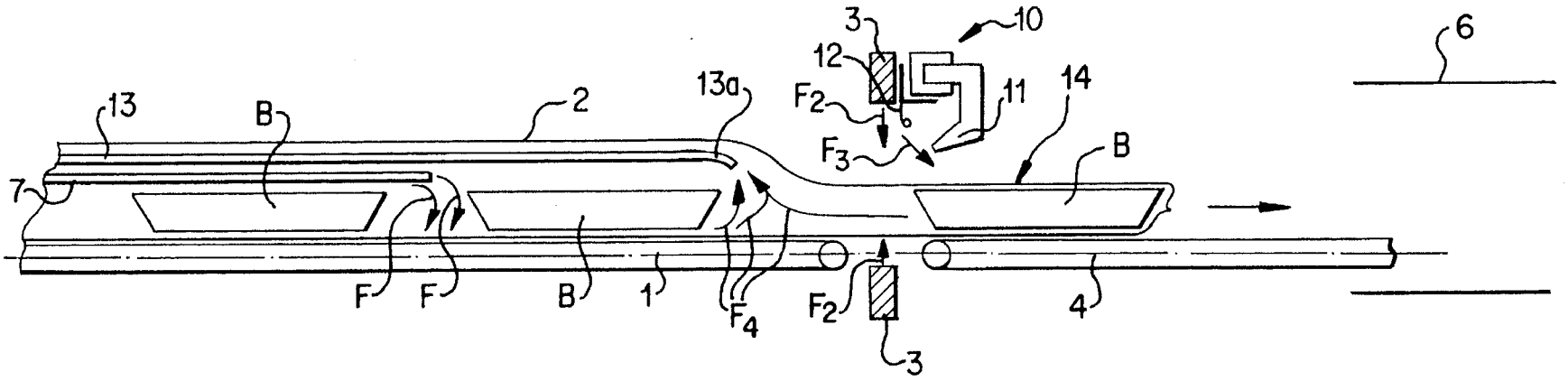

But further characterizing features and advantages of the invention will appear better in the detailed description which follows and refers to the accompanying drawings given by way of example only and in which:

FIG. 1 is a diagrammatic partial view of a conditioning machine according to this invention, illustrating the beginning of the phase of preshrinking of the tubular film at the front of the boat-shaped receptacle, and FIG. 2 is a view like the foregoing one but showing the tubular film at the end of the preshrinking when a vacuum is applied within the tubular film for sucking the gas injected at the rear of the boat-shaped receptacle.

One the drawings there is seen that the conditioning machine involved by this invention essentially comprises a conveyor 1 allowing the transport of a plurality of boat-shaped receptacles B housed inside of a tubular film 2 formed of a foil made from flexible plastics material, bars or jaws 3 for welding the tubular film upstream of the conveyor 1, another conveyor 4 for the transport of the boat-shaped receptacles B wrapped into a portion 5 of the tubular film 2 and upstream of this conveyor 4, a heat-shrinking furnace or tunnel diagrammatically shown at 6.

In the tubular film 2 is received at least one duct 7 which continuously injects into the said tubular film as physically shown by the arrows F, a gas suitable for the preservation of the product contained in the boat-shaped receptacles B.

The tubular film 2 is obtained from a foil paid out from a coil (not shown) and which is shaped on the machine so as to give it the shape of a tube which is continuously welded along one generating line. The boat-shaped receptacles B containing the product are inserted into the tube or the tubular film 2 owing to a chain with dogs (not shown) providing a space necessary to the boat-shaped receptacles B to permit the transverse welding of the tubular film or tube 2 carried by the conveyor 1 by means of the welding bars 3 and this at the rear portion of the boat-shaped receptacles. After welding each boat-shaped receptacle B is separated from the foregoing boat-shaped receptacle by a cutting system (not shown) and is thus enclosed within a tubular film portion 5 carried along by the conveyor 4 towards a hot-shrinking furnace 6.

All the arrangements referred to hereinabove are known per se and do not require additional explanations.

According to the invention an apparatus 10 with hot air injection nozzles 11 is provided above the conveyors 1 and 4 and is interposed between the conveyor 1 and the furnace 6. More specifically this apparatus 10 is interposed between the two conveyors 1 and 4 and is associated with the welding bars 3. With this apparatus 10 is also associated a means for injecting cold air by a nozzle or the like very diagrammatically designated at 12.

One has shown at 13 on the figures one or several ducts connected to a vacuum source (not shown) and located inside of the tubular film or tube 2. The duct or ducts 13 is or are opening with their end 13*a* adjacent to the closed forward end 2*a* of the tubular film or tube 2.

But for a better understanding of the invention, one will hereinafter explain the operation and the advantages of the machine described hereinabove.

The boat-shaped receptacles B filled with a product and contained in the tubular film 2 obturated at the front end 2*a* are carried along by the conveyor 1 whereas preserving gas is injected continuously by the duct 7 into the tubular film as is well seen on FIG. 1.

As physically shown by the arrow F 1 on this figure, hot air at about 500° C. for example is injected by the nozzles 11 onto the external wall of the tubular film 2 which is advancing and this from its forward end 2*a* down to about the middle portion of a boat-shaped receptacle B as designated at 14 on FIG. 2.

A this point the hot air injection is stopped and as physically shown by the arrow F3 on FIG. 2 cold air is injected by the nozzle 2 onto the tubular film or foil portion covering the rear of the boat-shaped receptacle.

Thus the film at the front portion of the boat-shaped receptacle will shrink under the effect of the hot air sent by the nozzles 11 to expell the preserving gas injected by the duct 7 whereas the cold air sent by the nozzle 12 constitutes in a way a safety for stopping the heat-shrinkage. This controlled shrinkage advantageously avoids any contact of the film with the product contained within the boat-shaped receptacle B hence any possible soiling of the film by this product whereas the cold air injected by the nozzle 12 will provide in a way for the holding of the film portion covering the rear of the boat-shaped receptacle to facilitate the welding operation by the welding bars 3.

Then a vacuum is applied within the tubular film or tube 2 and this owing to the duct 13. Thus as physically shown by the arrows F4 on FIG. 2, a sucking will occur in the tube 2 to complete the expelling of gas from the end of this tube and this at the same time as the closing of the welding bars 3 according to the arrows F2 will begin.

After a stop of the suction, the welding of the tubular film 2 at the rear of the boat-shaped receptacle B will be performed, and then a severing will be carried out to separate the boat-shaped receptacle B from the foregoing boat-shaped receptacles.

The boat-shaped receptacle B enclosed within the tubular film portion 5 the upper portion of which will not be stained by the product will then travel owing to the conveyor 4 towards the furnace 6 wherein a heat-shrinking of the tubular film on the boat-shaped receptacle will be effected, it being understood that the welding bars 3 as one sees it on FIG. 1 will return to the open position according to the arrow F5.

And the cycle of foregoing operating steps will be resumed on the following boat-shaped receptacle.

One has therefore provided according to the invention a method and a machine permitting the control of the rolling of the film onto the boat-shaped receptacle before its passage into the heat-shrinking furnace, so that the said film does not incur the risk of being stained by the product within the boat-shaped receptacle as this was earlier the case with the systems with a positive pressing with a form pad for example so that one obtains with the final packing a nice visual appearance which will be attractive for the consumer.

The invention is of course not at all limited to the embodiment described and illustrated which has been given by way of example only.

Thus the hot air nozzles 11 associated with the welding bars 3 could constitute at least two nozzles spaced from each other. Likewise the cold air nozzles 12 could be of any shape and number.

This means that the invention comprises all the technical equivalents of the means described as well as their combinations if the latter are carried out according to its gist.

We claim:

1. A process for packaging a product on a receptacle wherein the product and the receptacle are surrounded by a film, with a forward end the process comprising:

(A) advancing a tubing of film on a conveyor, the tubing housing the receptacle having the product thereon;

(b) sealing the tubing of film on the forward end;

(C) sending a gaseous mixture into the tubing;

(D) blowing heated air onto an outer surface of the sealed forward end of the film, so that a forward region of the tubing of film, from the sealed forward end of the tubing to the middle of the receptacle, is pre-shrunk, whereby a rearward expulsion of the gaseous mixture inside the forward region occurs;

(E) applying a vacuum inside the tubing from a rearward portion of the tubing of film, so that the expulsion of the gaseous mixture is completed, the expulsion of the gaseous mixture facilitating the welding of the tubing of film at the rear portion of the container;

(F) obturating the tubing of film by heat sealing the tubing of film in the area of a rearward end of the receptacle, whereby an obturated film tube portion is produced, the obturated film tube portion surrounding the receptacle having the product thereon;

(G) separating the obturated tubing film portion from a remainder of the tubing film; and (H) heat-shrinking the obturated tubing film portion.

2. The process according to claim 1, wherein before vacuum is applied inside the tubing, cool air is blown onto the outer surface of a region of the film covering the rearward end of the receptacle.

3. A machine for packaging a product on a receptacle product and the receptacle are surrounded by a film, with a forward end the machine comprising:

(A) a conveyor for transporting a receptacle enclosed in a tubing of film;

(B) means for sealing the tubing of film on the forward end;

(C) means for blowing heated air onto an outer surface of the sealed forward end of the film, so that a forward region of the tubing of film, from the sealed forward end of the tubing to the middle of the receptacle, is pre-shrunk, whereby a rearward expulsion of the gaseous mixture inside the forward region occurs;

(D) means for obturating the tubing film by heat sealing the tubing film in the area of a rearward end of the receptacle, whereby an obturated film tube portion is produced, the obturated film tube portion surrounding the receptacle having the product thereon; and (E) a furnace the heat-shrinking said tubing film;

wherein said means for blowing heated air is positioned between the conveyor and the furnace.

4. The machine according to claim 3, further comprising at least one duct inside the tubing and above the conveyor, the duct communicating with a vacuum source.

5. The machine according to claim 3, wherein the means for blowing heated air is associated with the means for obturating the tubing film.

6. The machine according to claim 5, further comprising at least one duct inside the tubing and above the conveyor, the duct communicating with a vacuum source.

7. The machine according to claim 3, further comprising means for blowing cool air onto the outer surface of a region of the film covering the rearward end of the receptacle.

8. The machine according to claim 5, further comprising at least one duct inside the tubing and above the conveyor, the duct communicating with a vacuum source.

9. The machine according to claim 7, wherein the means for blowing heated air is associated with the means for obturating the tubing film.

10. The machine according to claim 9, further comprising at least one duct inside the tubing and above the conveyor, the duct communicating with a vacuum source.

* * * * *